US006518911B2

(12) United States Patent
Strait et al.

(10) Patent No.: US 6,518,911 B2
(45) Date of Patent: Feb. 11, 2003

(54) NON-SKID, RADAR ABSORBING SYSTEM, ITS METHOD OF MAKING, AND METHOD OF USE

(75) Inventors: S. Jared Strait, Sterling Heights, MI (US); Martin A. Lindell, Troy, MI (US); Richard Norman Johnson, Encinitas, CA (US)

(73) Assignee: General Dynamics Land Systems, Inc., Sterling Heights, MI (US)

( * ) Notice: Subject to any disclaimer, the term of this patent is extended or adjusted under 35 U.S.C. 154(b) by 0 days.

(21) Appl. No.: 09/858,418

(22) Filed: May 16, 2001

(65) Prior Publication Data

US 2002/0171578 A1 Nov. 21, 2002

(51) Int. Cl.[7] ..... H01Q 17/00
(52) U.S. Cl. ..... 342/1; 342/2
(58) Field of Search ..... 342/1, 2, 3, 4; 428/212, 411.1

(56) References Cited

U.S. PATENT DOCUMENTS 4,606,848 A 8/1986 Bond
5,537,116 A * 7/1996 Ishino et al. ..... 342/1
5,552,455 A 9/1996 Schuler et al.
5,844,523 A 12/1998 Brennen et al.
5,853,889 A * 12/1998 Joshi et al. ..... 428/411.1
5,892,476 A 4/1999 Gindrup et al.
5,900,097 A 5/1999 Brown
6,037,046 A * 3/2000 Joshi et al. ..... 428/212

FOREIGN PATENT DOCUMENTS

WO WO-96/21700 A1 * 7/1996 ..... C09D/7/12

OTHER PUBLICATIONS

Richard N. Johnson, Radar Absorbing: A Passive Role in an Active Scenario, *http://www.randf.com/ramapriaas.html*; no date.

Miliary Specification: Deck Covering, Spray–On, Nonslip, MIL–D–24483A(Ships), Naval Publications and Forms Center, Philadelphia, PA.; Sep. 11, 1986.

* cited by examiner

*Primary Examiner*—Bernarr E. Gregory
(74) *Attorney, Agent, or Firm*—Brooks & Kushman P.C.

(57) ABSTRACT

A non-skid, radar absorbing system 10. The system absorbs and scatters incident microwave and/or millimeter wave radiation so as to decrease retro reflectance. The system includes an absorbing layer (RAM) 14 juxtaposed with a substrate 12. Disposed adjacent the RAM 14 is a non-skid matrix layer 16 for providing a safe foot hold. Optionally, a protective environmental topcoat 18 is applied to the non-skid layer 16. The system has electrical and magnetic characteristics such that radar energy at a discrete or broad-band frequencies is at least partially absorbed. The invention also includes methods of making and using the non-skid, radar absorbing system 10.

20 Claims, 1 Drawing Sheet

NON-SKID, RADAR ABSORBING SYSTEM, ITS METHOD OF MAKING, AND METHOD OF USE

BACKGROUND OF THE INVENTION

1. Field of the Invention

This invention relates to a non-skid, radar absorbing system disposed up on a substrate, its method of making, and a method of using the system.

2. Background Art

Radar absorbing materials (RAMs) are extensively used in various military applications, including stealth technology. They typically are coatings or bulk materials, the electrical and magnetic properties of which have been altered to allow the absorption of microwave energy at discrete or broadband frequencies.

Initial work on producing practical microwave absorbers predates World War II. Early efforts sought to reduce the detectability of a target, of which its radar cross-section (RCS) is a measure. Two types of materials were developed for this purpose. The first was a tuned-frequency, magnetically loaded rubber sheet (Wesch material). The second was a multi-layered material which was relatively thick (Jaumann absorber). It was formed from resistive sheets and low-dielectric plastic spacers.

Over the years, a search has been underway for RAMs that can be used on the surfaces of military targets to prevent them from being detected, located, or recognized by radar over a broad (2–100 GHz) radiation spectrum. But utilization of conventional RAMs generally requires thick applications, particularly at low frequencies. Such an approach creates bulkiness and difficulty in transportation and deployment. Further information about related considerations involving RAMs is found in K. J. Vinoy et al., "RADAR ABSORBING MATERIALS," Kluwer Academic Publishers (1996), which is incorporated by reference.

Another obstacle to the development of satisfactory RAMs has been the effect on radar absorption and reflectance of applying a non-skid coating to the RAM. This is because non-skid materials typically are aggregates that are heterogeneous and have electromagnetic characteristics that are incompatible with RAMs. As a result, the retro reflectance characteristics of RAM may become dramatically altered by the presence of a non-skid layer upon which microwaves impinge. A non-skid coating, however, is necessary for operational field use, particularly under conditions of moisture and motion, in order to provide a safe foot hold for military personnel.

To some extent, the electromagnetic characteristics of the RAM and the non-skid layer are also modified when a protective environmental coating is applied to the non-skid layer.

Prior art references noted during an investigation in connection with the present invention include these U.S. Pat. Nos.: 4,606,848 Bond; 5,552,455 Schuler et al.; 5,844,523 Brennan et al.; 5,892,476 Gindrup et al.; and 5,900,097 Brown.

SUMMARY OF THE INVENTION

It is an object of the invention to provide a non-slip or non-skid radar absorbing material (RAM) which will overcome the above and other disadvantages.

More specifically, an object of the invention is to provide a RAM system including a radar absorbing layer, a non-skid matrix layer disposed adjacent thereto, and an optional protective environmental coating applied to the non-skid layer. The RAM system is used on a substrate, often having a non-planar or complex topography. The substrate is representative of the surfaces of military hardware or equipment. Ideally, the overall bulkiness and weight of the system minimize their detrimental effects on the substrate to which the system is applied.

A further object of the invention is to provide a non-skid, RAM system which is capable of both absorbing and scattering incident microwave radiation over a wide spectrum of incident microwave energy, including microwave (2–20 GHz) and millimeter wavelengths (20–100 GHz) frequencies.

A still further objective of the invention is to provide a non-skid, RAM system that includes a protective environmental coating, where the system retains the desired radar attenuating characteristics.

Another object of the invention is to provide methods of making and using a RAM system that can be applied to a non-planar substrate so that the thickness of the system can be controlled within acceptable tolerance limits.

In carrying out the above objects, the non-skid, radar absorbing system of the invention includes a radar absorbing material (RAM) layer juxtaposed with a surface of the hardware or equipment to which the system is applied or affixed. A non-skid matrix layer is disposed adjacent the absorbing layer. Optionally, a protective environmental coating is applied to the non-skid layer. The layers and the topcoat form a radar absorbing system that has electrical and magnetic characteristics that enable microwave energy at discrete or broadband frequencies to be at least partially absorbed.

In one preferred embodiment of the radar absorbing system, the non-skid matrix layer comprises microballoons that alter the dielectric properties of the non-skid coating with minimal added weight.

Another embodiment of the non-skid RAM calls for the non-skid matrix layer to include less than about 5 volume percent of carbon fibers to imbue the system with changed electrical and magnetic properties with minimal further change in weight or volume. If desired, carbon fibers can be added to the non-skid matrix layer, the fibers having an average ratio of length to diameter between about 20 to about 40.

In yet another preferred embodiment, the non-skid matrix layer includes a non-skid additive selected from the group consisting of silicon dioxide, pumice, quartz, aluminum, aluminum oxide, other ceramics, crushed walnuts and mixtures thereof.

In another preferred embodiment of this system, the non-skid RAM is covered with a chemical agent-resisting coating (CARC) as the environmental coating.

Still further preferred modes of practicing the invention include its method of making and use.

The objects, features and advantages of the present invention are readily apparent from the following detailed description of the best modes for carrying out the invention when taken in connection with the accompanying drawings.

DETAILED DESCRIPTION OF THE PREFERRED EMBODIMENTS

Figure 1:
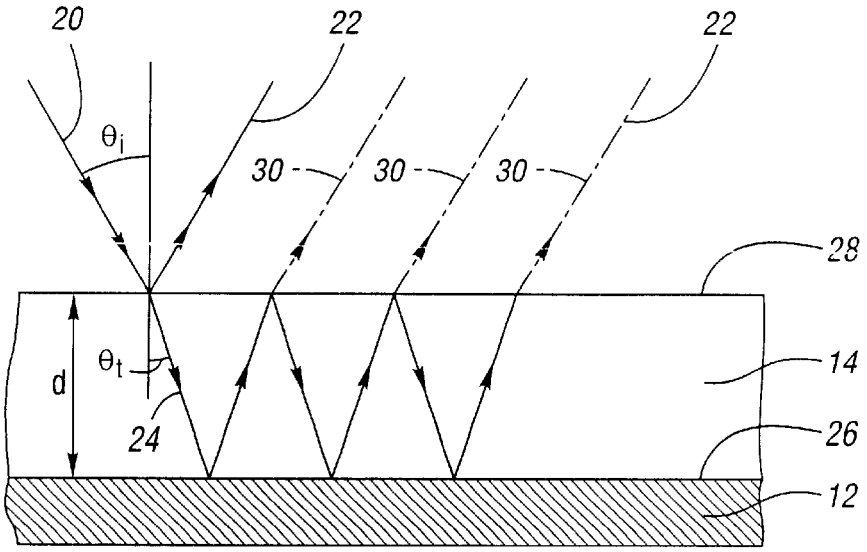
FIG. 1 is a schematic cross-section of an absorber showing out-of-phase conditions existing between reflected and emergent waves.

Turning first to FIG. 1, there is depicted, for simplicity, a radar absorbing material (RAM) coating 14 which covers a substrate 12, often in the form of a metal reflector that is part of a piece of military hardware or equipment. Although the substrate 12 is depicted in FIG. 1 as planar, it will be appreciated that the disclosed invention may be applied to nonplanar substrates that may or may not have complex topographies.

When a radar wave, indicated by the reference numeral 20 is incident upon the top surface 28 of the RAM coating 14 at an angle ($\theta_i$), it splits into two components. One component 22 reflects off the top surface 28 as a primary reflection. The other component 24 is refracted at an angle ($\theta_t$) and travels into the coating 14 until it impinges upon the interface 26 between the RAM coating 14 and the substrate 12, from whence it is reflected back toward the top surface 28 and refracted outwardly therefrom as a secondary wave 30.

Ideally, RAM coatings for radar absorbers must balance the primary and secondary waves 20, 30 and achieve a phase shift between the two waves in order to achieve satisfactory radar attenuation. In practice, radar absorbers minimize the energy reflected from the front face and absorb most of the radar energy internally before it reaches an impedance mismatch and is reflected back ("retro reflectance").

It will be appreciated that desirably, a RAM coating must be light in weight and have a high attenuation level over a broad frequency range. Conventionally, relatively high attenuation occurs when the primary reflection coefficient is equal in magnitude to the secondary reflection coefficient so that coefficients are 180° out of phase. It is known that the bandwidth of maximum attenuation is increased by having about one-third of the energy reflected as the primary reflection coefficient, and about two-thirds of the energy absorbed in the radar absorbing layer as a result of phase cancellation between the primary and secondary reflections.

Figure 2:
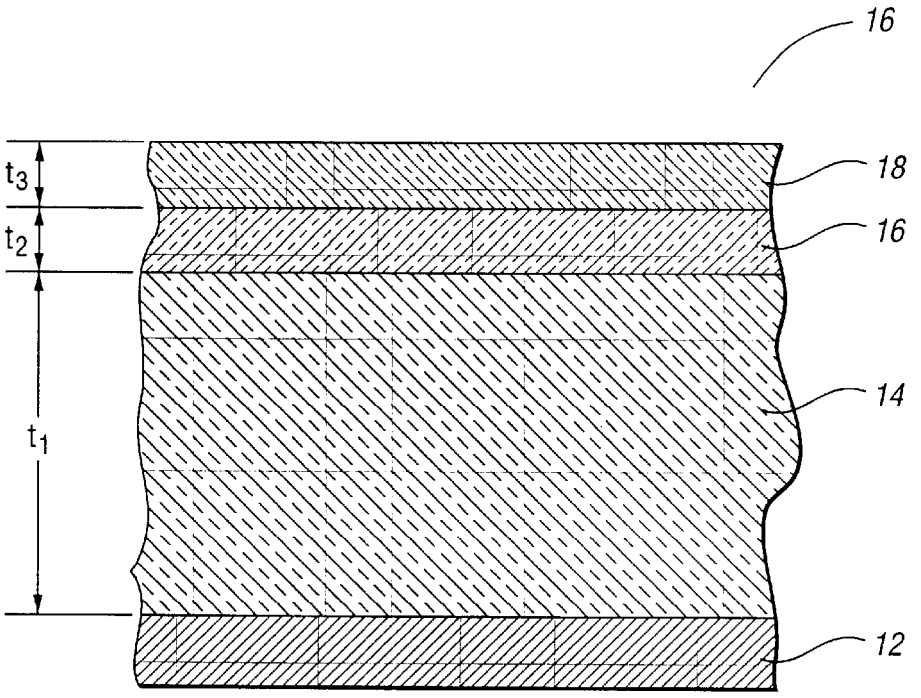
FIG. 2 is a sectional view of a non-skid, radar absorbing system made in accordance with the invention.

Turning next to FIG. 2, one embodiment of a non-skid, radar absorbing system 10 is depicted adjacent a substrate 12. The system absorbs and scatters incident radiation so as to decrease reflectance.

The system includes a radar absorbing material (RAM) layer 14 having a thickness $t_1$ juxtaposed with the substrate 12. The materials of which the RAM layer 14 is made are selected so that they have a magnetic permeability $\mu_1$ and permittivity $\epsilon_1$ that characterize the magnetic and electrical properties of the layer 14. Disposed adjacent the RAM 14 is a non-slip or non-skid matrix layer 16 having a thickness $t_2$ for providing a safe foot hold. The non-skid matrix layer 16 likewise has magnetic and electrical properties that are characterized by its magnetic permeability $\mu_2$ and permittivity $\epsilon_2$. Optionally, a chemical agent-resistant coating (CARC) topcoat 18 having a thickness $t_3$ is applied to the non-skid layer 16. The CARC topcoat 18 itself has a magnetic permeability $\mu_3$ and permittivity $\epsilon_3$. The system has overall electrical and magnetic characteristics (magnetic permeability ($\mu$) and permittivity ($\epsilon$)) such that microwave and/or millimeter wavelength energy at discrete or broadband frequencies is at least partially absorbed.

In an alternate embodiment of the invention, the non-skid matrix layer 16 and protective environmental coating pigments distributed within the non-skid matrix layer 16 comprise a composite layer having a thickness $t_c$, a selected magnetic permeability $\mu_c$ and permittivity $\epsilon_c$. The composite layer is disposed adjacent the absorbing layer 14. In this embodiment, the system has electrical and magnetic characteristics $\mu$, $\epsilon$ that are tuned. The thicknesses $t_1$ and $t_c$ are selected such that microwave energy and/or millimeter wavelength energy at discreet or broadband frequencies is at least partially absorbed. If desired, the protective environmental coating pigments include chemical agent-resisting pigments.

In another embodiment, the non-skid, radar absorbing system comprises an absorbing non-skid composite layer having a thickness $t_{c2}$, a selected magnetic permeability $\mu_{c2}$ and permittivity $\epsilon_{c2}$ disposed adjacent the substrate. The absorbing non-skid composite layer comprises an absorbing material having a selected magnetic permeability $\mu_1$ and permittivity $\epsilon_1$, and a non-skid material with selected magnetic permeability characteristics $\mu_2$ and permittivity $\epsilon_2$ disposed within the absorbing material.

In other embodiments, the non-skid, radar absorbing system includes one or more absorbing layers, one or more non-skid matrix layers, and one or more protective environmental coatings.

Principles of Operation

The invention embodies a microwave absorbing system 10 that is produced by altering or tuning the dielectric and magnetic properties of selected materials. Common dielectric materials used for absorbers, such as foams, plastics and elastomers have no magnetic properties. They have permeabilities of 1. Magnetic materials, such as ferrites, iron and cobalt-nickel alloys are often used to alter the permeabilities of selected materials. High dielectric materials such as carbon, graphite and metal flakes may also be used to modify dielectric properties, equations and models (e.g., Debye oscillator, Jaumann, and Maxwell Garnett) that are well known govern the magnitude of the reflection coefficient. For a detailed discussion of Debye oscillator and Maxwell Garnett equations which describe artificial dielectrics, see C. F. Bohren & D. R. Huffman, "ABSORPTION AND SCATTERING OF LIGHT BY SMALL PARTICLES," John Wiley & Sons (1983).

Materials

At the outset, it should be emphasized that various examples and embodiments of the invention are to be illustrated and described herein. It is not intended that these examples and embodiments illustrate and describe all possible forms of the invention.

In general, radar absorbers are one of two basic types: resonant or graded dielectric. The present invention describes resonant absorbers and, more particularly, multilayer, dual frequency resonant absorbers.

For any given frequency, the cancellation of primary and secondary waves is dependent upon two factors. Permittivity ($\epsilon$) controls the speed at which a wave propagates through the RAM layer and is in turn controlled by the amount or thickness of the layer.

To maintain non-skid characteristics while providing radar absorption, the non-skid, radar absorbing system of this invention includes an absorbing layer 14 juxtaposed with the substrate 12. As the work leading to the present invention evolved, it became apparent that the non-skid layer could not be transformed into a RAM. Instead, in one embodiment, the non-skid material became an integral part of the RAM layer.

The non-skid, radar absorbing system of the invention embraces both sprayable and cast (i.e., laminate) versions of the product using such binders, by way of nonlimiting examples, as urethane and epoxy-based resins. In the laminate embodiment, the RAM layer 14 was formed using with a two-part non-skid system, such as that available under the product name Courtalds PRA 452/455. In the sprayed embodiment, the sprayable RAM was prepared using urethanes and epoxy resin systems, which have dielectric constants of ~3.0 and loss tangents below 0.1. To manufacture an absorbing paint such as that used in the non-skid radar absorbing system, energy loss must be achieved. One way to do this is by the addition of "lossy" fillers to the RAM layer. Because weight is a consideration, carbon fibers and lossy microballoons were investigated.

Two carbon fiber lengths (0.030" and 0.040") were used. Four different types of microballoons were studied. They were tungsten plated glass microballoons with a diameter of 50 microns. An aluminum oxide insulating layer was overplated to stop percolation (conductivity) at high filler concentrations. The processing of each of the batches was different, which changed the thickness of the aluminum oxide covered tungsten layer.

The four types of microballoons manufactured by the 3M Company with product designations 59, 61, 63, and 65 were loaded at ~50% volume concentration in a Ciba Geigy RP6405 urethane resin. The mixture was cast into a 12"× 11"×0.125" tool and cured at 125 degrees F for 2 hours. The two fibers were a Grafil 0.030" fiber and an RK Fibre 0.040" fiber. Both types of fiber were about 7 microns in diameter, with an estimated resistivity of 0.1 ohm per cm. These fibers were loaded in the same resin system at 0.2% concentration along with 30% volume glass microballoons. They were cast into sheets similar to the 3M microballoons.

Other more flexible urethane resin systems were investigated, including Courtalds 1664D, 90 shore A flexible urethane; and BJB F-70 flexible urethane. The BJB Material had acceptable viscosity and a shorter cure time. This material was chosen as the preferred binder for subsequent casting.

Casting was the manufacturing method used to characterize the filler materials. Sheet materials were cast to analyze the filler properties at various volume concentrations.

A sprayable epoxy resin was also used to produce samples for evaluation. In one example, a Wilshire Products E-1366 two-part epoxy was chosen. This epoxy was curable at room temperature.

Evaluation Method

Although other models could be used, the Debye oscillator model, as referenced in the "Principles of Operation" section above, was selected to represent and extrapolate measured data to higher frequencies. This model produced favorable properties in the samples studied, as evidenced by actual transmission and reflection measurements at the higher frequencies.

To derive $\epsilon$, a computer program fitted a series of data into a Debye oscillator model and computed the oscillator's parameters. Samples were measured in a free space insertion tunnel from 4–18 GHz. Insertion loss and phase data were captured over that frequency range. The program used those data to calculate $\epsilon$ real (which quantifies the speed and phase of energy transmission) and imaginary (which quantifies loss component) over that frequency range. The program executed a least squares fit optimization and calculated the Debye Oscillator constants for the material. The material optimizer program used as its inputs the Debye oscillator properties and optimized ("tuned") each layer for thickness (t); oscillator strength, i.e., the difference in real $\epsilon$ values between low and high frequencies; and resonant frequency.

The consequence of this characterization is that once an oscillator's properties are known, the material behaves predictably. As the filler concentration increases, for example, the strength of the oscillator increases.

Sheets of material were built with various fillers at different volume concentrations. The insertion properties of these sheets were measured and $\epsilon$ real and imaginary were calculated. These properties were used as inputs to compute the optimum properties to achieve absorption at milliwave frequencies, a desired object for subsequent layers.

Observations

Some rising of the 3M microballoons was noted due to the low viscosity of the resin system and slow cure time. Subsequent trials were conducted with the BJB-70 flexible urethane resin. Further settling problems were not noted. The 0.030" fibers dispersed well into the resin. The fibers were sensitive to the pouring techniques used. To minimize anisotropy of the fibers, some flow patterns were noted in the cured sheet. The 0.040" fibers tended to clump together and did not disperse well in the resin. This clumping caused localized concentrations in some areas, but resulted in only minimal changes in electrical properties of the final sheet.

Measurements of the initial samples were taken using a HP8720 B vector network analyzer and an AEL broadband 2–18 GHz antenna. A computer program automatically took insertion loss and phase changes from the analyzer. These data were reformatted as an input file and the real and imaginary $\epsilon$ computed. A least squares fit reduction to a Debye oscillator model was determined and the four Debye parameters computed. The results were calculated from 6–18 GHz. A 6" aperture size was used in the tunnel. Data below 6 GHz were considered inaccurate. Each sample was measured in two orientations (0,90 degrees) to check for effects of anisotropy in the sample preparation. In general, the microballoon data correlated well in both orientations. The fiber data showed differences in the orientation and in general did not conform to Debye predictions. This fact, coupled with the difficulty in manufacturing with fibers consistently, suggested microballoons as a preferred embodiment.

The design data showed 3M-61 to have a higher oscillator strength for the same loading as the other microballoons. Two of the balloons (3M-59 and 61) were selected for further evaluation.

Based upon the above observations, a second set of samples was molded to ~0.070" thick. Six tiles were manufactured: 1 of each microballoon type, at 3 volume percentage loadings (45%, 50%, 54%). The samples were measured similarly to the initial samples, and the Debye parameters computed.

It was observed that the 3M-61 balloons had a lower resonant frequency and a higher strength than the 3M-59 balloons. Strength rose with increased loading, and the resonant frequency diminished. The high frequency real $\epsilon$ showed no definite trends, but was highest in the 54% volume 3M-61 balloon. Each sample was optimized as a standalone layer with a 0.005" non-skid layer and 0.002" CARC layer on top. The addition of outer layers tended to thin out the absorber layer. Each sample was sanded to a thickness predicted in the model.

A thin film of the CARC was drawn out on a 0.005" piece of mylar. Two colors (green and tan) were fabricated. The cured film thickness was between 0.002" and 0.003". Insertion loss and phase measurements on the films were taken and their dielectric properties were determined. The CARC was urethane-based. It was expected to have a dielectric constant between 3 and 4. The CARC had a dielectric constant that was independent of frequency. The values obtained at 6–18 GHz were used to design at higher frequencies.

The non-skid layer was a more difficult material to model. Generally, the electromagnetic theories invoked are dependent upon homogenous layers, the antithesis of a non-skid material. The material was generally thin (0.002") where there was paint only. However the thickness increased to 0.040" and more, but over small areas. In one experiment, the non-skid material included a urethane resin, which generally has a dielectric constant of ~3–4. The aggregate consisted of three main materials: crushed glass (silicon dioxide, $\epsilon$ r~6), aluminum oxide ($\epsilon$ r~8) and pumice (E$\epsilon$ r~4–6). The percentages and sizes of the fillers were: glass, 0.033"–0.039", 25% weight; aluminum oxide, 0.033", 35% weight; and pumice 0.008"–0.016", 7% weight.

Since the material was heterogeneous, the concept of an effective dielectric constant was adopted. A sample of the non-skid material was measured in 1"×1" increments over thousands of square inches, and the resultant dielectric values were averaged. The variation in the properties resulted in various reflection coefficients for the absorber below it. The overall reflectivity was the averaged sum of the smaller samples.

Effect of the CARC and Non-Skid Layers

To measure the effect of the non-skid and optionally applied CARC layers, a series of samples was prepared. Non-skid material was coated on 0.005" mylar in various concentrations. In all, there were 8 samples made. Sample 1 had almost no aggregate at all, while sample 8 was similar to the original non-skid samples produced. All 8 samples were subsequently coated with CARC to produce the final samples. There was very little effect on the energy transmission from samples 1–5. At the higher concentrations, some change was noted.

The final samples of 50% by volume of the 3M-61 balloons were investigated in spray trials. The balloons were loaded into Part A of an E-1366 epoxy resin. The resin was formulated by the Wilshire Coating Company. It was a 2-part, room temperature curable resin with good toughness and flexibility. The samples were sprayed by hand onto 0.005" Mylar in several passes to build up the appropriate thickness. After a final cure, the sample was released from the Mylar and sanded to the thickness of the design. These samples were also further tested.

Millimeter Wave Length Testing

Swept frequency measurements were made over both frequency ranges. Since these material s were resonant absorbers, it was necessary to determine the resonant peak, so further optimization could be obtained. Amplitude and phase data at both frequency ranges assisted in the optimization of the design. The designs were based upon predicted $\epsilon$ data from measurements made in the microwave range. Further study investigated how the predicted data compared to the actual measured data.

Reflectivity measurements were made over both frequency ranges. Samples were measured as is, and then several samples were remeasured with the non-skid coating being tack bonded to the surface. A sample was chosen for most of the extra measurements because it had the best overall performance. It was measured at both frequencies with all of the non-skid coating attached to it. Samples of each loading density were also measured with a non-skid coating to see if the change in performance was consistent for all materials. Several of the non-skid coatings were measured by themselves to see if there was a significant scattering effect to the material. The dielectric properties of each material were measured at 201 points over 32–50 Ghz and higher frequencies.

In all cases, the measured reflectivity of the individual samples was below −10 dB at higher frequencies. The peak was not deep but in general centered close to the predicted frequency. Once the non-skid layer was bonded, performance improved significantly. With the top non-skid layer attached, the resonant performance was tuned to be slightly lower than the higher frequency nominal. However, the peak was better than 30 dB and was better than −20 dB at the higher frequency. The non-skid layer had the effect of a matching layer and assisted the energy to more efficiently couple with the absorber. As the non-skid layer got heavier, the peak moved to a lower frequency. This was consistent with theory, since it made the absorber thicker. The results at 35 GHz were not as dramatic, but in several of the samples, the reflectivity reduction was below the 10 dB desired goal. The peaks were usually on the low side of the frequency band. With further tuning, a consistent 35 GHz absorber was produced, with a reflectivity of −10 dB.

These investigations revealed that the non-skid radar absorbing system preferably includes microsphere fillers for weight reduction. More preferably, the microspheres are coated with a metallic layer (e.g., tungsten) that in turn is coated with a suitable insulating layer to provide electrical isolation.

Using the experimental procedure described herein, the system was tuned for frequency ranges of interest, with emphasis on the Ka and W band performance.

The disclosed invention provides various advantages over other RAM systems. One advantage is that the disclosed system maintains non-skid characteristics, while providing radar absorption. The non-skid system complies with military specifications (e.g., MIL-C-24667A, which is incorporated herein by reference). MIL-C-24667A defines a required coefficient of static friction for each type of non-skid material under wet, dry, and oily conditions. Thus, as used in this patent application, the term "non-skid" is used to refer to a coating which imparts a high coefficient of friction, and thus traction. This makes it difficult for a user to slip and fall on the surface. Additionally, the disclosed system is reasonably light in weight, due to the inclusion of microsphere filler materials. Finally, the sprayable version of the disclosed system provides the desirable capability of coating complex geometries and surface configurations without significant labor requirements that are common to most laminate systems.

It should be appreciated that ranges of values have been disclosed and claimed herein for certain parameters. In such cases, Applicants intend that the scope of such ranges embraces ranges that are equivalent to those disclosed and claimed.

Though embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. While the best modes for carrying out the invention have been described in detail, those familiar with the art to which the invention relates will recognize other ways of practicing the invention as defined by the following claims.

What is claimed is:

1. A non-skid, radar absorbing system disposed adjacent a substrate, the system comprising:

an absorbing layer having a thickness $t_1$, a selected magnetic permeability $\mu_1$ and permittivity $\epsilon_1$ juxtaposed with the substrate; and a non-skid matrix layer having a thickness $t_2$, a selected magnetic permeability $\mu_2$ and permittivity $\epsilon_2$ disposed adjacent the absorbing layer, the system having electrical and magnetic characteristics $\mu$, $\epsilon$ that are tuned, and the thicknesses $t_1$, and $t_2$ are selected such that incident wavelength energy at discrete or broadband frequencies is at least partially absorbed.

2. The non-skid, radar absorbing system of claim 1, further comprising:

a protective environmental coating having a thickness $t_3$, a selected magnetic permeability $\mu_3$ and permittivity $\epsilon_3$ applied to the non-skid matrix layer, the system having electrical and magnetic characteristics $\mu$, $\epsilon$ that are tuned, and the thicknesses $t_1$, $t_2$ and $t_3$ are selected such that microwave and/or millimeter wavelength energy at discrete or broadband frequencies is at least partially absorbed.

3. The non-skid, radar absorbing system of claim 2, wherein:

the protective environmental coating comprises a chemical agent-resisting topcoat.

4. The non-skid, radar absorbing system of claim 1, wherein the substrate is non-planar.

5. The non-skid, radar absorbing system of claim 1, wherein the absorbing layer includes:

microballoons that alter the dielectric properties thereof.

6. The non-skid, radar absorbing system of claim 5, wherein the microballoons comprise:

hollow ellipsoids at least partially filled with air.

7. The non-skid, radar absorbing system of claim 5, wherein the microballoons include:

a metallic coating with an overcoating of an insulator that envelops at least portions of at least some of the microballoons so that they are electrically isolated from each other.

8. The non-skid, radar absorbing system of claim 1, wherein the non-skid matrix layer includes less than about 5 volume percent of carbon fibers to impart changed electrical and magnetic properties to the system with minimal change in volume or weight.

9. The non-skid, radar absorbing system of claim 8, wherein the non-skid matrix layer includes carbon fibers having an average ratio of length to diameter between 20 and 40.

10. The non-skid, radar absorbing system of claim 8, wherein the non-skid matrix layer includes carbon fibers having a resistivity between 0.01 and 10 ohm-cm.

11. The non-skid, radar absorbing system of claim 1, wherein the non-skid matrix layer includes a resin with an additive selected from the group consisting of silicon dioxide, pumice, quartz, aluminum, aluminum oxide, other ceramics, crushed walnuts, and mixtures thereof.

12. A non-skid, radar absorbing system disposed adjacent a substrate, the system comprising:

an absorbing layer having a thickness $t_1$, a selected magnetic permeability $\mu_1$ and permittivity $\epsilon_1$ juxtaposed with the substrate; and a composite layer having a thickness $t_c$, a selected magnetic permeability $\mu_c$ and permittivity $\epsilon_c$ disposed adjacent the absorbing layer, the composite layer comprising a non-skid matrix; and protective environmental coating pigments dispersed within the non-skid matrix, the system having electrical and magnetic characteristics $\mu$, $\epsilon$ that are tuned, and the thicknesses $t_1$ and $t_c$ are selected such that incident wavelength energy at discrete or broadband frequencies is at least partially absorbed.

13. The non-skid, radar absorbing system of claim 12, wherein:

the protective environmental coating pigments comprise chemical agent-resisting pigments.

14. A non-skid, radar absorbing system disposed adjacent a substrate, the system comprising:

an absorbing non-skid composite layer having a thickness $t_{c2}$, a selected magnetic permeability $\mu_{c2}$ and permittivity $\epsilon_{c2}$ disposed adjacent the substrate, the absorbing non-skid composite layer comprising an absorbing material having a selected magnetic permeability $\mu_1$ and permittivity $\epsilon_1$; and a non-skid material having a selected magnetic permeability $\mu_2$ and permittivity $\epsilon_2$ dispersed within the absorbing material; and a protective environmental coating having a thickness $t_3$, a selected magnetic permeability $\mu_3$ and permittivity $\epsilon_3$ applied to the absorbing non-skid composite layer, the system having electrical and magnetic characteristics $\mu$, $\epsilon$ that are tuned and the thicknesses $t_{c2}$ and $t_3$ are selected such that incident wavelength energy at discrete or broadband frequencies is at least partially absorbed.

15. The non-skid, radar absorbing system of claim 14, wherein:

the protective environmental coating comprises a chemical agent-resisting topcoat.

16. A non-skid, radar absorbing system disposed adjacent a substrate, the system comprising:

one or more absorbing layers, one of the one or more absorbing layers being juxtaposed with the substrate;

one or more non-skid matrix layers, one of the one or more non-skid matrix layers being disposed adjacent one of the absorbing layers; and one or more protective environmental coatings applied to one of the one or more non-skid matrix layers, the system having electrical and magnetic characteristics that are tuned, and the thicknesses of the layers are selected such that incident wavelength energy at discreet or broadband frequencies is at least partially absorbed.

17. The non-skid, radar absorbing system of claim 16 wherein one or more of the layers is applied by a spraying step.

18. The non-skid, radar absorbing system of claim 16 wherein one or more of the layers is formed by a casting step.

19. A method of making a non-skid, radar absorbing system comprising the steps of:

preparing an absorbing layer including a dispersion of microballoons;

spraying the absorbing layer and the dispersion of microballoons upon a substrate;

applying a non-skid matrix layer to the absorbing layer and the dispersion of microballoons; and applying a protective environmental coating to the non-skid matrix layer.

20. A method of using a non-skid, radar absorbing system disposed adjacent a substrate, the system having an absorbing layer, a non-skid matrix layer and a protective environmental coating applied to the non-skid matrix layer, comprising the steps of:

preparing the absorbing and non-skid matrix layers;

applying the layers to a substrate; and applying the protective environmental coating on top of one of the layers, so that incident wavelength energy at discrete or broadband frequencies is at least partially absorbed.

* * * * *